US006371597B1

(12) United States Patent
DeMeerleer et al.

(10) Patent No.: US 6,371,597 B1
(45) Date of Patent: Apr. 16, 2002

(54) TAB CIRCUIT TO MINIMIZE CORROSION DUE TO INK

(75) Inventors: Jan Richard DeMeerleer, Lexington; Jeffrey Louis Sangalli, Shelbyville, both of KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 09/488,502

(22) Filed: Jan. 20, 2000

(51) Int. Cl.[7] ..... B41J 2/14
(52) U.S. Cl. ..... 347/50
(58) Field of Search ..... 347/50, 58, 64, 347/86, 87

(56) References Cited

U.S. PATENT DOCUMENTS

| | | | | | |
|---|---|---|---|---|---|
| 4,989,317 | A | | 2/1991 | Firl et al. | 29/840 |
| 5,250,844 | A | | 10/1993 | Smith | 257/695 |
| 5,442,386 | A | | 8/1995 | Childers et al. | 347/50 |
| 5,598,194 | A | * | 1/1997 | Hall et al. | 347/50 |
| 5,610,642 | A | | 3/1997 | Nobel et al. | 347/50 |
| 5,612,511 | A | | 3/1997 | Meyer et al. | 174/254 |
| 5,729,261 | A | | 3/1998 | Burke et al. | 347/64 |
| 5,736,998 | A | | 4/1998 | Caren et al. | 347/45 |
| 5,748,209 | A | | 5/1998 | Chapman et al. | 347/50 |
| 5,812,165 | A | | 9/1998 | Boyd et al. | 347/87 |
| 5,852,460 | A | | 12/1998 | Schaeffer et al. | 347/87 |
| 6,084,612 | A | * | 7/2000 | Suzuki et al. | 347/50 |

* cited by examiner

*Primary Examiner*—Craig A. Hallacher
(74) *Attorney, Agent, or Firm*—D. Brent Lambert; Mark P. Crockett

(57) ABSTRACT

A flexible circuit on an ink jet print head cartridge provides electrical connection between a control circuit in an ink jet printer and electrical contacts on a print head integrated circuit. During operation of printer, the contacts and the flexible circuit are exposed to a corrosive ink contained in the cartridge. The flexible circuit includes a first conductor for electrically connecting to a contact on the print head integrated circuit. The first conductor carries a first voltage when the flexible circuit is connected to the control circuit. A second conductor is disposed adjacent the first conductor for electrically connecting to another contact on the print head integrated circuit. When the flexible circuit is connected to the control circuit the second conductor carries a second voltage which is different from the first voltage. Thus, a voltage difference exists between the first conductor and the second conductor. The first conductor includes a first conductive lead and a second conductive lead which is separated from the first conductive lead by a separation distance. The second conductive lead is physically closer to the second conductor than is first conductive lead. The voltage difference between the first and second conductors, and presence of corrosive ink between the first and second conductors, causes an electrical current to flow between them. The electrical current flow causes corrosion of the first conductor. However, the second conductive lead corrodes at a faster rate than does the first conductive lead. Thus, the second conductive lead acts as a sacrificial lead, and reduces the corrosion rate of the first conductive lead. In this manner, the present invention prolongs the useful lifetime of the first conductor and the print head cartridge.

7 Claims, 6 Drawing Sheets

(Section AA)

34
34
42
42
42
42
32
32
11
36
36
26
16
26
22
24
24
22
44
32
38
32

TAB CIRCUIT TO MINIMIZE CORROSION DUE TO INK

FIELD OF THE INVENTION

The present invention is generally directed to tape automated bonding (TAB) circuits used in ink jet printer cartridges. More particularly, the invention is directed to reducing corrosion, and the harmful effects thereof, due to ink in contact with electrical conductors on a TAB circuit.

BACKGROUND OF THE INVENTION

Typically, an ink jet print head chip is mounted within a chip window on a flexible TAB circuit. The TAB circuit attaches to a print head cartridge and provides electrical contact pads for connecting to corresponding contacts in the ink jet printer. The TAB circuit includes many closely-spaced electrically-conductive traces that connect the print head chip to the contact pads. Typically, metal leads span the chip window to connect the traces to connection points on the chip.

Ink supply channels within the print head chip receive ink from an ink reservoir in the print head cartridge. Through capillary action, the ink flows into the channels and is provided to ink-heating elements. The ink-heating elements are selectively activated to cause ejection of ink droplets toward a print medium. Due to the close proximity of the print head chip to the source of the ink, and due to the low viscosity of the ink, the ink tends to flow around the edges of the print head chip and come in contact with the leads and the traces.

Many formulations of ink are somewhat conductive and corrosive. When a space between two leads of a TAB circuit is filled with such ink, and an electrical potential exists between the leads, an electrical current may flow through the ink from one lead to the other. This current flow causes electrochemical corrosion of the source lead, that is, the lead that is the source of the current flow. The corrosion narrows the lead over time, and eventually corrodes the lead completely through, rendering the print head chip partially or completely inoperable.

Therefore, a TAB circuit design is needed that reduces electrochemical corrosion between leads and that reduces its harmful effects.

SUMMARY OF THE INVENTION

The foregoing and other needs are met by a flexible circuit on an ink jet print head cartridge. The flexible circuit provides electrical connection between a control circuit in an ink jet printer and electrical contacts on a print head integrated circuit that is attached to the flexible circuit. During operation of the ink jet printer, the contacts and the flexible circuit are exposed to a corrosive ink contained in the cartridge. The flexible circuit includes a flexible nonconductive substrate that conforms to the print head cartridge. On the substrate is a first conductor for electrically connecting to a contact on the print head integrated circuit. The first conductor has a first voltage thereon when the flexible circuit is connected to the control circuit. A second conductor is disposed on the substrate adjacent the first conductor for electrically connecting to another contact on the print head integrated circuit. The second conductor has a second voltage thereon when the flexible circuit is connected to the control circuit, where the second voltage is different from the first voltage. Thus, a voltage difference exists between the first conductor and the second conductor. The first conductor has a first conductive lead and a second conductive lead. The second conductive lead is disposed substantially parallel to the first conductive lead, and is separated from the first conductive lead by a separation distance. The second conductive lead is physically closer to the second conductor than is first conductive lead. The voltage difference between the first conductor and the second conductor, and presence of corrosive ink between the first conductor and the second conductor, causes an electrical current to flow between the first conductor and the second conductor. The flow of electrical current causes corrosion of the first conductor. However, the second conductive lead of the first conductor corrodes at a faster rate than does the first conductive lead.

Thus, the second conductive lead acts as a sacrificial lead, and reduces the corrosion rate of the first conductive lead. In this manner, the first conductor having two separate leads lasts longer in the corrosive ink environment than it would if it had only a single lead. Therefore, the present invention prolongs the useful lifetime of the flexible circuit and the print head cartridge.

BRIEF DESCRIPTION OF THE DRAWINGS

Further advantages of the invention will become apparent by reference to the detailed description of preferred embodiments when considered in conjunction with the drawings, which are not to scale, wherein like reference characters designate like or similar elements throughout the several drawings as follows.

DETAILED DESCRIPTION OF THE INVENTION

Figure 1:
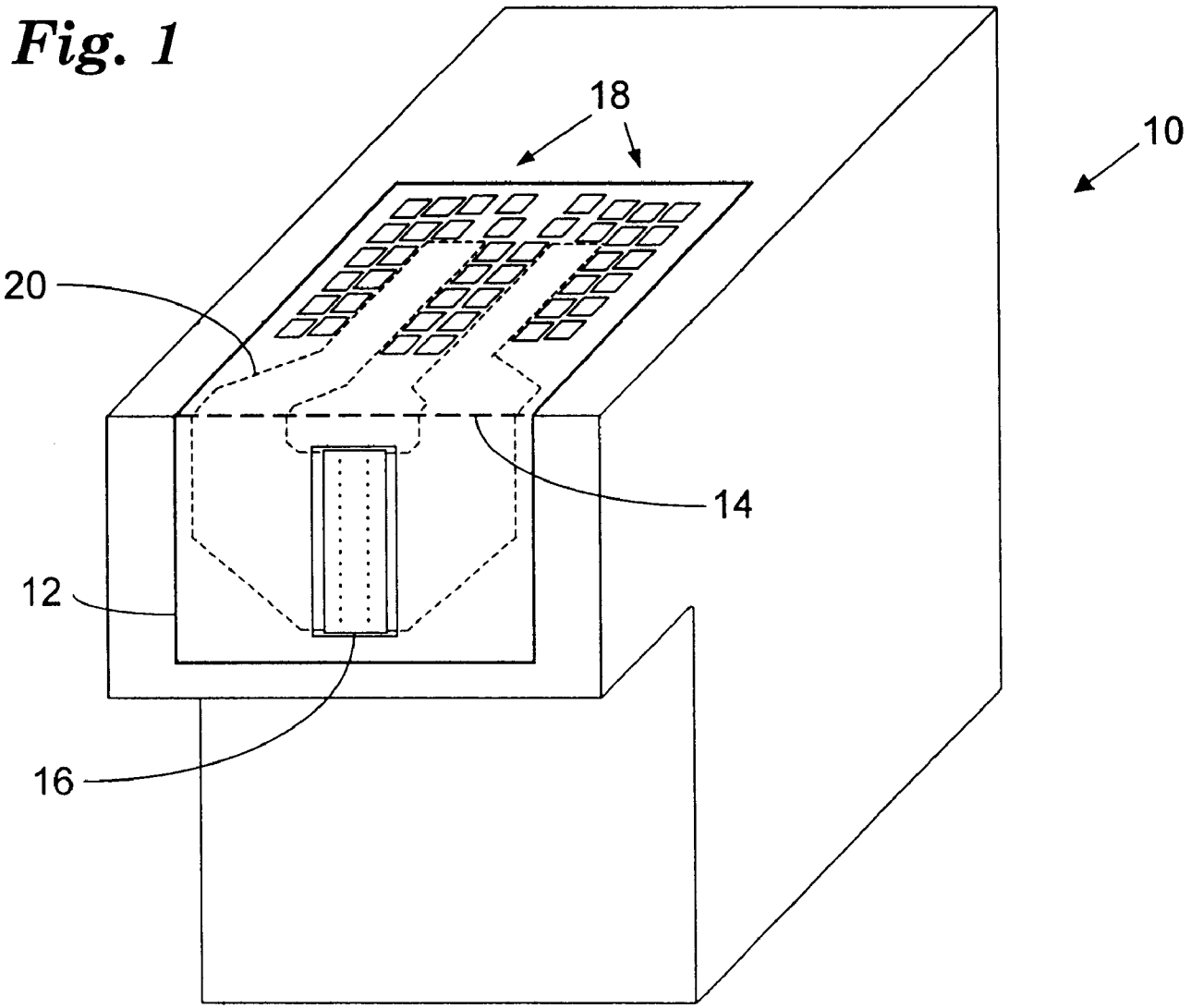
FIG. 1 depicts an ink jet print head according to a preferred embodiment of the invention.

Shown in FIG. 1 is an ink jet print head cartridge 10 such as may be used in an ink jet printer. As used herein the phrase "print head cartridge" refers to any cartridge having a print head for use in an ink jet printer. Examples of such cartridges include semi-permanent print heads used in conjunction with replaceable ink cartridges, and replaceable ink cartridges having integral print heads. Thus, the invention described herein is not limited to any particular configuration of cartridge.

Attached to the print head cartridge 10 is a tape automated bonding (TAB) circuit 12 formed on a flexible substrate of polyimide tape. The flexible nature of the TAB circuit 12 provides for bending the TAB circuit 12 around a corner 14 of the print head cartridge 10, as shown in FIG. 1. Attached to the TAB circuit 12 is a print head integrated circuit chip 16 which contains heater resistors to heat ink, and switching devices to selectively activate the heating resistors. When the heater resistors are activated, ink that is immediately adjacent to the resistors is vaporized, thereby causing formation of an ink bubble. The ink bubble forces a droplet of ink outward through a nozzle which is adjacent the heater resistor. The ink droplet exits the nozzle and strikes a print medium which is adjacent the print head cartridge 10, thereby forming a dot on the medium.

The activation of any particular heater resistor in the chip 16 is based on control signals received from a microprocessor controller in the printer. Electrical connection between the controller and the print head cartridge 10 is provided by a set of print head contact pads 18 on the TAB circuit 12. Electrical connection between the contact pads 18 and the chip 16 is provided by a set of parallel metallized traces 20 that are formed on the substrate material. The traces 20 are collectively represented in FIG. 1 by the dotted outline region. Generally, there is a separate trace 20 electrically connecting each contact pad 18 to the chip 16. In the typical TAB circuit 12, the traces 20 include power, address, select, and ground traces running between the contact pads 18 and the chip 16.

Figure 2:
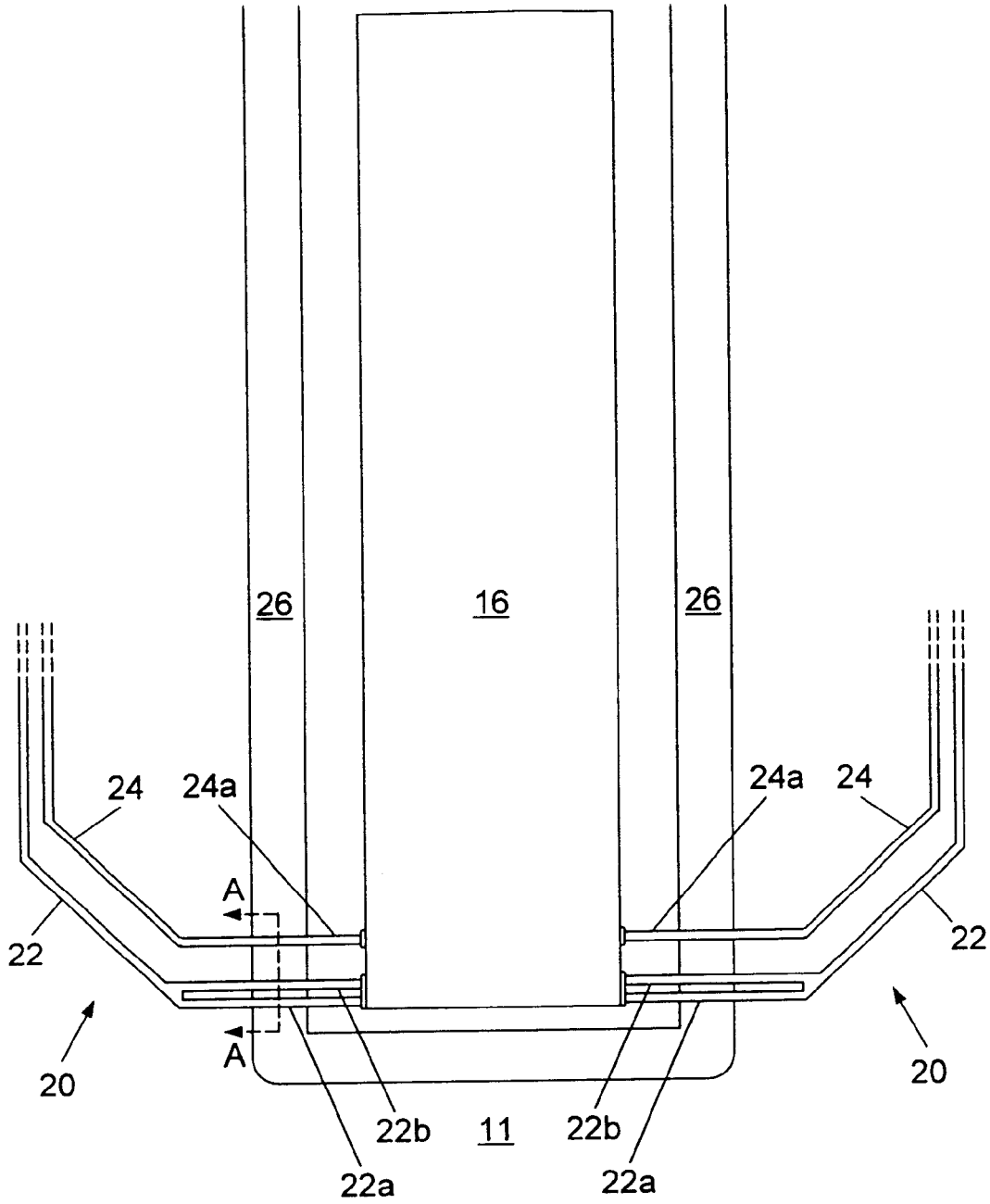
FIG. 2 depicts conductive leads on a TAB circuit according to a preferred embodiment of the invention.

Depicted in FIG. 2 is an enlarged view of the print head chip 16 and a representative portion of the traces 20 that run between the chip 16 and the contact pads 18. According to the preferred embodiment of the invention a first conductor 22, hereinafter referred to as select trace 22, is bifurcated such that it makes electrical contact with the chip 16 through a first conductive lead 22*a* and a second conductive lead 22*b*. Hereinafter, these two leads are referred to as select leads 22*a* and 22*b*, respectively. The select leads 22*a* and 22*b* are separated by a minimal separation distance. Next to the select lead 22*b* is a second conductor 24*a*, hereinafter referred to as adjacent lead 24*a*. During printer operation, the adjacent lead 24*a* carries a lower voltage than do the select leads 22*a*–22*b*, or is energized at a lower duty cycle than are the select leads 22–22*b*. Since the adjacent lead 24*a* carries a lower voltage, or is energized at a lower duty cycle, there is frequently a potential difference between the select leads 22*a*–22*b* and the adjacent lead 24*a*.

The select leads 22*a*–22*b* and the adjacent lead 24*a* span a chip window 26 that separates the TAB substrate 11 from the chip 16. During typical operation of the print head cartridge 10, it is not unusual for ink to flow around the edges of the chip 16 and come in contact with the traces 20. Due to print head wiping operations that occur from time to time particularly heavy deposits of ink typically gather at the top and bottom edges of the chip 16, such as around the area in which the select leads 22*a*–22*b* and the adjacent lead 24*a* are disposed. Thus, it is not uncommon or the select leads 22*a*–22*b* and the adjacent lead 24*a* to be completely immersed in ink as the print head is operating.

Figure 3:
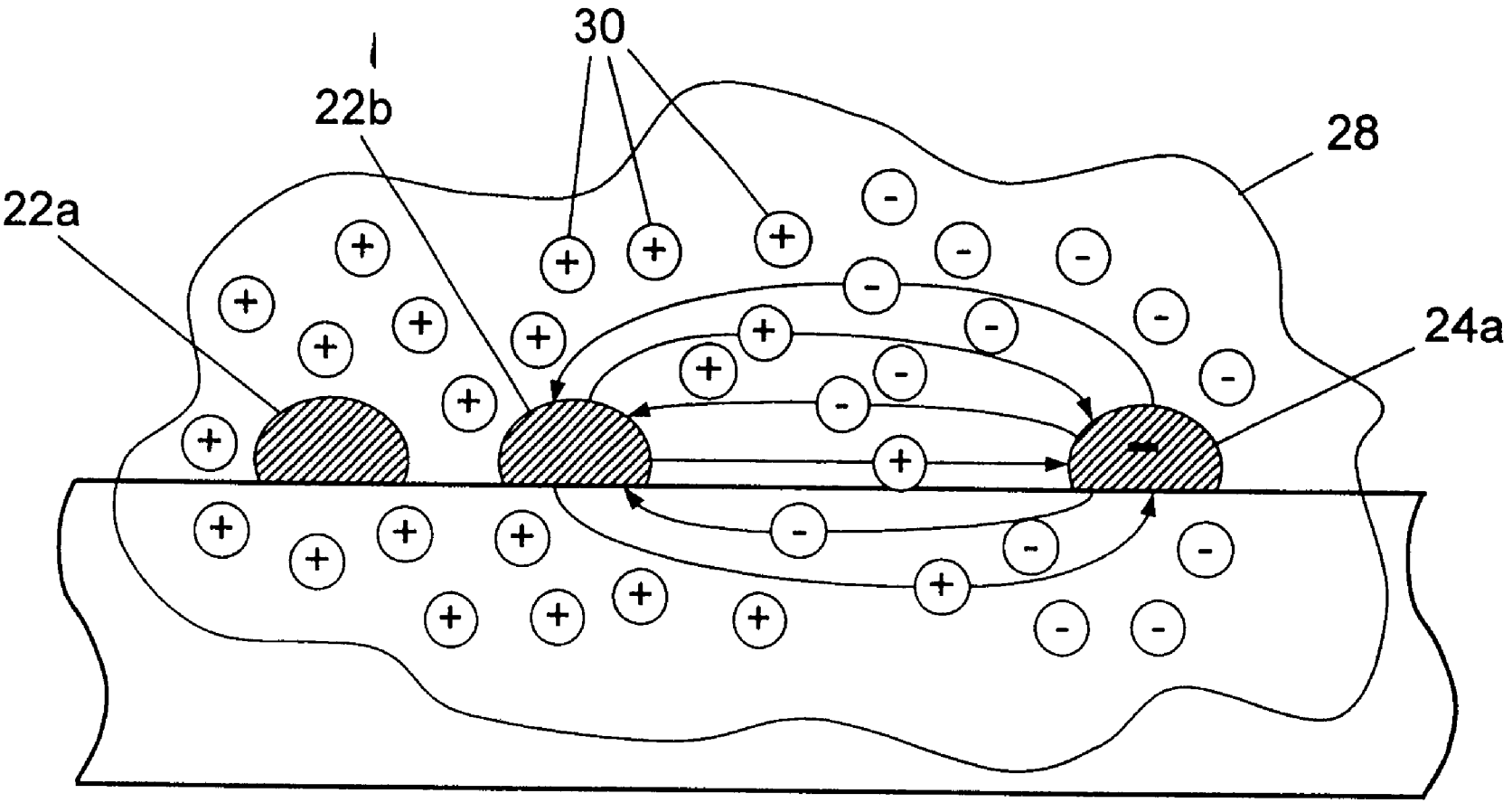
FIG. 3 is a cross-sectional view of conductive leads on a TAB circuit according to a preferred embodiment of the invention.

As shown in the cross-sectional view of FIG. 3 (taken at section I—I in FIG. 2), ink 28 may completely surround the select leads 22*a*–22*b* and the adjacent lead 24*a*. The types of ink 28 typically used in ink jet print head cartridges contain salts in solution and are conductive. Thus, the ink 28 can be highly corrosive to charge-carrying electrodes such as the select leads 22*a*–22*b*. As illustrated in FIG. 3 an electrochemical reaction occurs at the interfaces between the charged metal leads and the ink 28. Due to the potential difference between the positively-charged select leads 22*a*–22*b* and the relatively less charged adjacent lead 24*a*, the select leads 22*a*–22*b* give up positively-changed metal ions 30 into the ink 28. These positively-charged ions 30 undergo hydration (combination with water) and enter the ink solution.

The on-going loss of metal ions 30 into the ink 28 during print head operation causes the select leads 22*a*–22*b* to gradually dissolve. However, since the select lead 22*b* is physically closer to the adjacent lead 24*a*, there is a stronger electrochemical interaction between the lead 22*b* and the lead 24*a* than there is between the lead 22*a* and the lead 24*a*. Therefore, the select lead 22*b* dissolves at a significantly faster rate than the select lead 22*a*.

As the select lead 22*b* dissolves, the concentration of positively-changed metal ions 30 in the finite amount of ink 28 surrounding the select lead 22*a* radically increases. Because the ionic concentration of the ink 28 around the lead 22*a* approaches the ionic concentration on the surface of the lead 22*a*, the corrosion rate of the lead 22*a* is dramatically reduced.

Thus, due to the close proximity of the select lead 22*b* to the adjacent lead 24*a*, the select lead 22*b* acts as a "sacrificial" lead by corroding at a much faster rate than the select lead 22*a*. In this manner, the select lead 22*b* slows the corrosion of the select lead 22*a* and extends the useful lifetime of the select lead 22*a* well beyond the reasonable lifetime of the ink jet cartridge 10.

Figure 4:
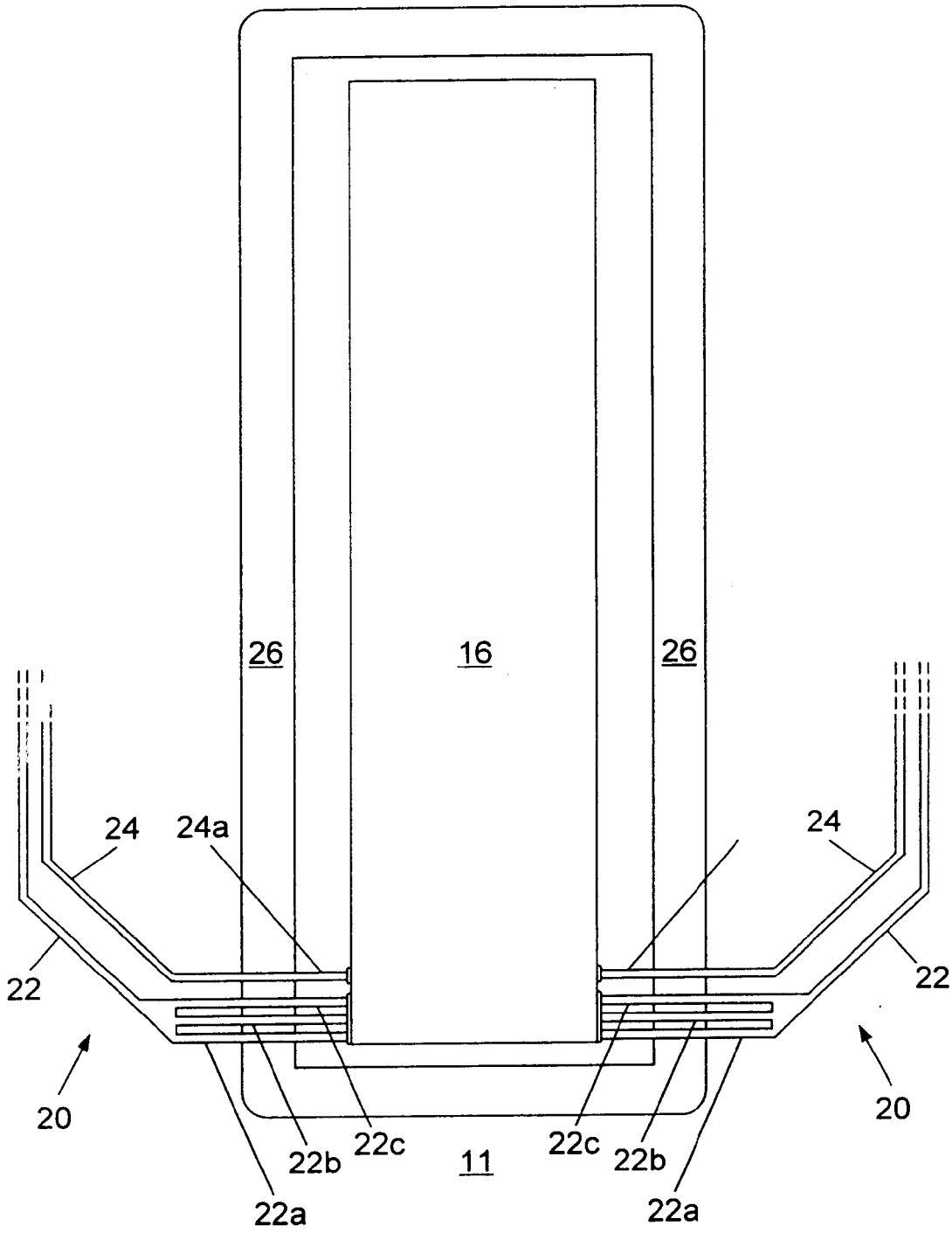
FIG. 4 depicts conductive leads on a TAB circuit according to another embodiment of the invention.

It will be appreciated that more than one sacrificial lead could be used to extend the useful lifetime of the select lead 22*a* even further. In another embodiment of the invention, as shown in FIG. 4, the lead 22 is trifurcated, thereby providing two sacrificial leads 22*b* and 22*c*. Since lead 22*c* is closer to the adjacent lead 24*a* than is lead 22*b*, the lead 22*c* corrodes at a faster rate than does the lead 22*b*. Thus, the lead 22*c* extends the lifetime of the lead 22*b*. Once the lead 22*c* corrodes completely away, the lead 22*b* remains between the lead 22*a* and the adjacent lead 24*a*. The lead 22*b* then acts to slow the corrosion rate of the select lead 22*a* as described above.

One skilled in the art will appreciate that even more sacrificial leads could be used between the select lead 22*a* and the adjacent lead 24*a*. Of course, the number of sacrificial leads that could be used is limited by the amount of space available on the chip 16 between the select lead 22*a* and the adjacent lead 24*a*.

Figure 5:
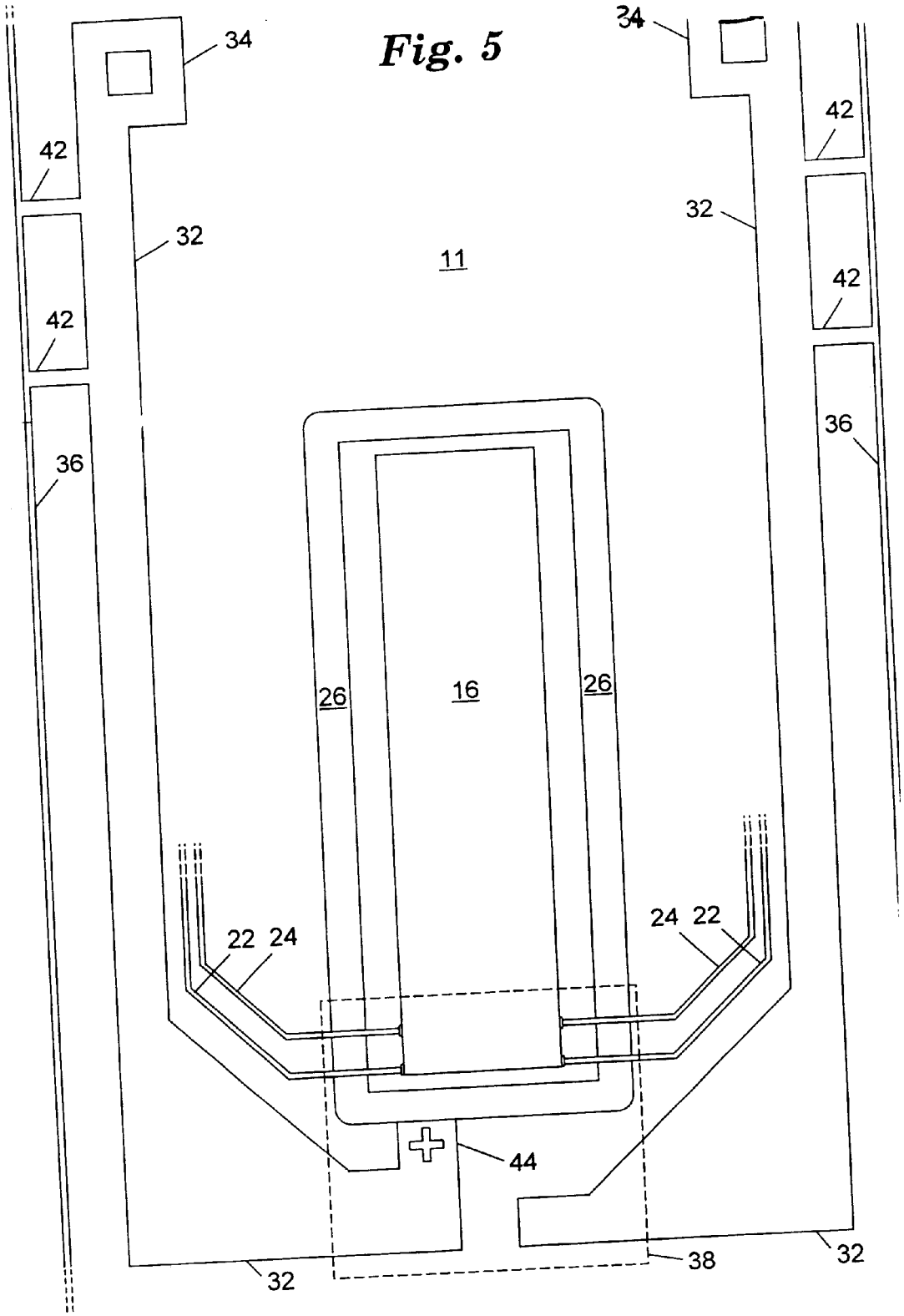
FIG. 5 depicts a conventional TAB circuit design.

The embodiments of the invention described thus far are effective in reducing electrochemical corrosion of the select lead 22*a* due to its close proximity to an adjacent lead 24*a* carrying a lower electrical potential. However, other structures on the TAB circuit that are exposed to the ink 28 may also have a lower electrical potential than the select lead 22*a*. For example, as shown in FIG. 5, a conventional TAB circuit typically has a metal plane 32 which fills the corners of the circuit below and to either side of the chip window 26. This plane 32 usually consists of metal which is deposited on the substrate 11 at the same time that the electrical conductors such as the traces 22 and 24, are deposited. Although the metal plane 32 typically consists of multiple parallel strips of metal, the plane 32 is represented in FIG. 5 as a continuous sheet so as to not unnecessarily complicate the depiction. The main purpose of the metal plane 32 is to provide structural rigidity to certain portions of the TAB circuit 12 and to provide for uniform electroplating of metal conductors.

As shown in FIG. 5, an outer metal rail 36 on either edge of the TAB circuit carries an electroplating voltage during the electroplating process. The electroplating voltage is provided to the plane 32 through one or more connection traces 42 disposed between the rail 36 and the plane 32. In the conventional TAB circuit of FIG. 5, a grounding pad 34 is also connected directly to the metal plane 32. When the metal rail 36 is removed from the edge of the TAB circuit after completion of electroplating, the metal plane 32 is still electrically connected to the grounding pad 34. Thus, during normal operation of the conventional TAB circuit, the grounding pad 34 and the metal plane 32 are both connected to the printer ground.

As depicted in FIG. 5, the grounded metal plane 32 of the conventional TAB circuit closely approaches the select line 22 in a region 38 of the TAB circuit that is typically immersed in ink. Therefore, in a conventional TAB circuit design, an electrochemical corrosion path is provided between the metal plane 32 and the select line 22. The resulting electrochemical corrosion ultimately dissolves the select line 22 and leads to electrical failure of the print head cartridge 10.

Figure 6:
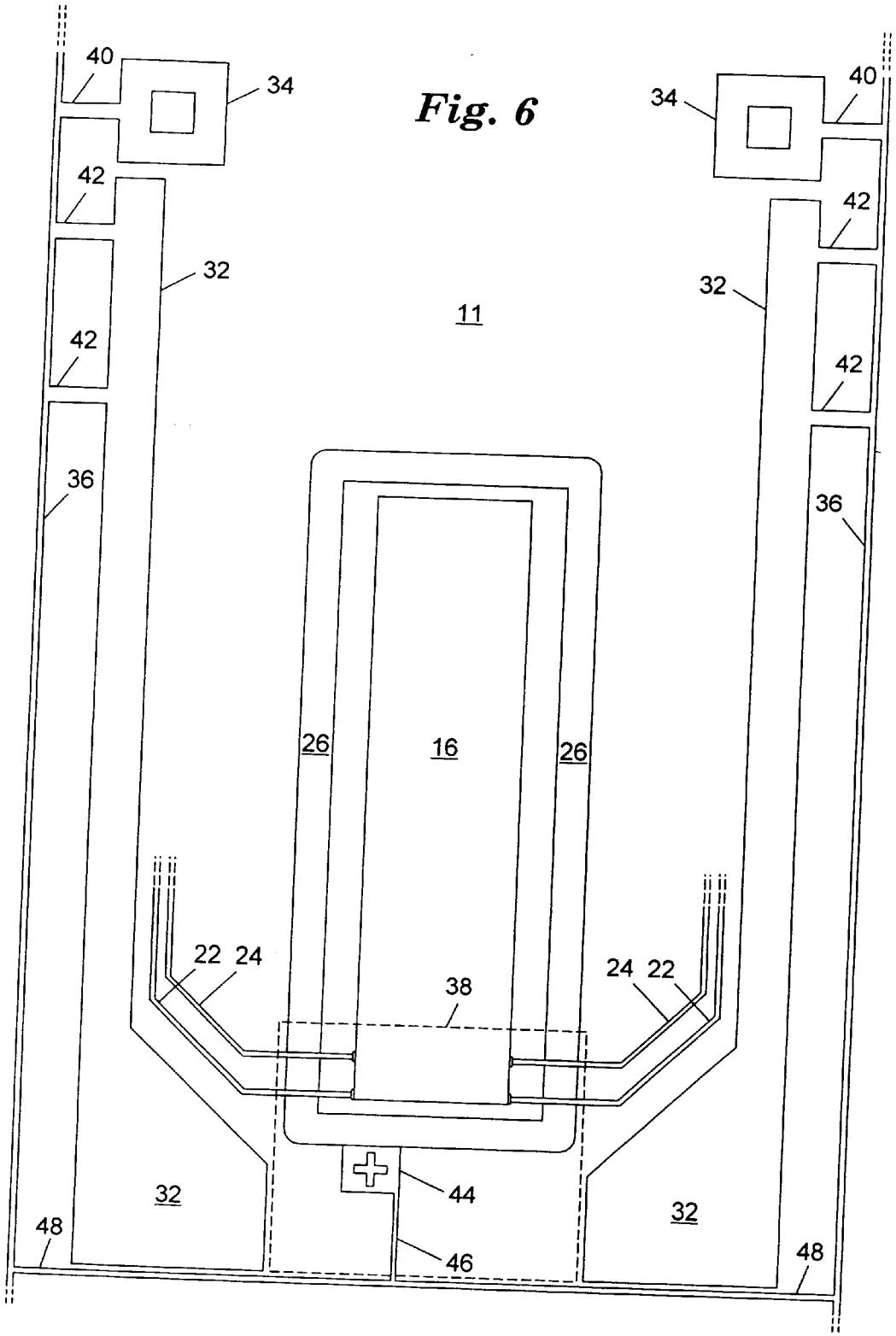
FIG. 6 depicts a TAB circuit design according to a preferred embodiment of the invention.

A preferred embodiment of the present invention, as shown in FIG. 6, addresses this corrosion problem in two ways. First, the metal plane 32 is completely disconnected from the grounding pad 34. In this way, the metal plane 32 is not grounded during operation of the print head cartridge 10. For purposes of electroplating the grounding pad 34, the invention provides a connection trace 40 between grounding pad 34 and the outer metal rail 36. This connection trace 40 is independent of connection traces 42 between the metal plane 32 and the outer metal rail 36. Thus, after electroplating is complete and the outer metal rail 36 has been removed from the TAB circuit 12, the metal plane 32 is no longer electrically connected to the grounding pad 34.

The invention provides a second way of preventing corrosion of the select lead 22 by moving the metal plane 32 out of the region 38 which is normally exposed to ink. In the conventional TAB circuit depicted in FIG. 5, the metal plane 32 extends into the region 38 near the select line 22 in which ink is typically present during print head operation. As discussed above, the ink in this region 38 provides an electrochemical corrosion path between the select line 22 and the metal plane 32.

In a preferred embodiment of the invention, as shown in FIG. 6, the metal plane 32 is physically isolated from the region 38 of the TAB circuit 12. Since the metal plane 32 does not extend into the region 38, there is no electrochemical corrosion path between the metal plane 32 and the select lead 22. Thus, this embodiment of the present invention further extends the expected operational lifetime of the print head cartridge 10 by eliminating yet another contributor to the corrosion of the select lead 22.

With reference again to FIG. 5, the conventional TAB circuit includes a metal crossin fiducial 44 adjacent the chip window 26. Conventionally, this fiducial 44 is connected directly to the metal plane 32, as shown in FIG. 5. During electroplating of the conventional TAB circuit, the fiducial 44 receives the electroplating voltage from the metal plane 32.

Those skilled in the art will appreciate that the fiducial 44 is needed during optical alignment of the chip 16 within the chip window 26. Thus, in the preferred embodiment of the invention shown in FIG. 6, the fiducial 44 preferably remains at the same position relative to the chip 16 as it is in the conventional design of FIG. 5. However, since the metal plane 32 has been moved out of the region 38 ol highest ink concentration, the metal plane 32 is not connected directly to the fiducial 44. In the preferred embodiment, the electroplating voltage is provided to the fiducial 44 via a connection trace 46 and a cross rail 48 that is connected to the outer rail 36. After completion of the electroplating process and removal of the outer rail 36 from the edge of the TAB circuit 12, the fiducial 44 is electrically isolated from the printer ground. Thus, in the preferred embodiment, there is no electrochemical corrosion path between the select lead 22 and the fiducial 44.

It is contemplated, and will be apparent to those skilled in the art from the preceding description and the accompanying drawings that modifications and/or changes may be made in the embodiments of the invention. Accordingly, it is expressly intended that the foregoing description and the accompanying drawings are illustrative of preferred embodiments only, not limiting thereto, and that the true spirit and scope of the present invention be determined by reference to the appended claims.

What is claimed is:

1. A flexible circuit for use on an ink jet print head cartridge, the circuit for providing electrical connection between a control circuit in an ink jet printer and electrical contacts on a print head integrated circuit attached to the flexible circuit, wherein the contacts and the flexible circuit are exposed to a corrosive ink contained in the cartridge during operation of the ink jet printer, the flexible circuit comprising:

a flexible nonconductive substrate operable to conform to the print head cartridge;

a first conductor disposed on the substrate for electrically connecting to a contact on the print head integrated circuit, the first conductor having a first voltage thereon when the flexible circuit is connected to the control circuit, the first conductor comprising:

a first conductive lead; and a second conductive lead disposed substantially parallel to the first conductive lead and separated from the first conductive lead by a separation distance;

a second conductor disposed on the substrate adjacent the first conductor for electrically connecting to a contact on the print head integrated circuit, the second conductor having a second voltage thereon when the flexible circuit is connected to the control circuit, the second voltage being different from the first voltage, such that a voltage difference exists between the first conductor and the second conductor; and the first conductor further comprising the second conductive lead being physically closer to the second conductor than is the first conductive lead, where the voltage difference between the first conductor and the second conductor, and presence of corrosive ink between the first conductor and the second conductor causes an electrical current to flow between the first conductor and the second conductor, where the flow of electrical current causes corrosion of the first conductor, and where the second conductive lead of the first conductor corrodes at a faster rate than does the first conductive lead.

2. The flexible circuit of claim 1 wherein the first conductor further comprises a third conductive lead disposed substantially parallel to the first and second conductive leads and separated from the second conductive lead by the separation distance, the third conductive lead being physically closer to the second conductor than are the first or second conductive leads.

3. The flexible circuit of claim 1 wherein the first voltage on the first conductor has a higher duty cycle than does the second voltage on the second conductor during the operation of the ink jet printer.

4. The flexible circuit of claim 1 wherein the first voltage on the first conductor is usually more positive than is the second voltage on the second conductor during operation of the ink jet printer.

5. The flexible circuit of claim 1 further comprising:

a ground conductor disposed on the substrate that is grounded relative to the control circuit when the flexible circuit is electrically connected to the control circuit; and a planar metal structure disposed on the substrate for providing structural rigidity to portions of the flexible circuit, the planar metal structure being electrically isolated from the first conductor, the second conductor and the ground conductor, where no electrical potential exists between the planar metal structure and the first conductor due to the planar metal structure being electrically isolated from the ground conductor, and where the lack of electrical potential between the planar metal structure and the first conductor prevents flow of electrical current between the planar metal structure and the first conductor when the planar metal structure and the first conductor are exposed to corrosive ink thereby preventing corrosion of the first conductor.

6. The flexible circuit of claim further comprising:

a ground conductor disposed on the substrate that is grounded relative to the control circuit when the flexible circuit is electrically connected to the control circuit, and a metal fiducial disposed on the substrate adjacent the print head integrated circuit, the fiducial being electrically isolated from the first conductor, the second conductor, and the ground conductor where no electrical potential exists between the fiducial and the first conductor due to the fiducial being electrically isolated from the ground conductor, and where the lack of electrical potential between the fiducial and the first conductor prevents flow of electrical current between the fiducial and the first conductor when the fiducial and the first conductor are exposed to corrosive ink, thereby preventing corrosion of the first conductor.

7. A tape automated bonding (TAB) circuit for use on an ink jet print head cartridge, the TAB circuit for providing electrical connection between a control circuit in an ink jet printer and electrical contacts on a print head integrated circuit attached to the TAB circuit, wherein the contacts and the TAB circuit are exposed to a corrosive ink contained in the cartridge during operation of the ink jet printer, the TAB circuit comprising a flexible nonconductive substrate operable to conform to the print head cartidge;

a first conductor disposed on the substrate for electrically connecting to a contact on the print head integrated circuit, the first conductor having a first voltage thereon when the TAB circuit is connected to the control circuit, the first conductor comprising:

a first conductive lead; and a second conductive lead disposed substantially parallel to the first conductive lead and separated from the first conductive lead by a separation distance;

a second conductor disposed on the substrate adjacent the first conductor for electrically connecting to a contact on the print head integrated circuit, the second conductor having a second voltage thereon when the TAB circuit is connected to the control circuit, the second voltage being usually more positive than the first voltage such that a voltage difference usually exists between the first conductor and the second conductor during operation of the ink jet printer;

the first conductor further comprising the second conductive lead being physically closer to the second conductor than is the first conductive lead, a ground conductor disposed on the substrate that is grounded relative to the control circuit when the flexible circuit is electrically connected to the control circuit;

a planar metal structure disposed on the substrate for providing structural rigidity to portions of the flexible circuit, the planar metal structure being electrically isolated from the first conductor, the second conductor, and the ground conductor; and a metal fiducial disposed on the substrate adjacent the print head integrated circuit, the fiducial being electrically isolated from the first conductor, the second conductor, and the ground conductor, where the voltage difference between the first conductor and the second conductor, and presence of corrosive ink between the first conductor and the second conductor causes an electrical current to flow between the first conductor and the second conductor, where the flow of electrical current causes corrosion of the first conductor, and where the second conductive lead of the first conductor corrodes at a faster rate than does the first conductive lead, where no electrical potential exists between the planar metal structure and the first conductor due to the planar metal structure being electrically isolated from the ground conductor, and where the lack of electrical potential between the planar metal structure and the first conductor prevents flow of electrical current between the planar metal structure and the first conductor when the planar metal structure and the first conductor are exposed to corrosive ink, thereby preventing corrosion of the first conductor, and where no electrical potential exists between the fiducial and the first conductor due to the fiducial being electrically isolated from the ground conductor, and where the lack of electrical potential between the fiducial and the first conductor prevents flow of electrical current between the fiducial and the first conductor when the fiducial and the first conductor are exposed to corrosive ink, thereby preventing corrosion of the first conductor.

* * * * *